US006220235B1

(12) United States Patent
Sands

(10) Patent No.: US 6,220,235 B1
(45) Date of Patent: Apr. 24, 2001

(54) BOW TUNING APPARATUS WITH A NOCK TRAVEL INDICATOR

(76) Inventor: William L. Sands, 237 Carvel Rd., Pasadena, MD (US) 21122

( * ) Notice: Subject to any disclaimer, the term of this patent is extended or adjusted under 35 U.S.C. 154(b) by 0 days.

(21) Appl. No.: 09/447,068

(22) Filed: Nov. 22, 1999

(51) Int. Cl.[7] ..... F41B 5/14
(52) U.S. Cl. ..... 124/1; 124/86
(58) Field of Search ..... 124/1, 23.1, 86

(56) References Cited

U.S. PATENT DOCUMENTS 5,222,473 * 6/1993 Lint ..... 124/86
5,370,103 * 12/1994 Desselle ..... 124/86
5,433,186 * 7/1995 Corwin ..... 124/86
5,628,300 * 5/1997 Wallendorff ..... 124/1
5,954,041 * 9/1999 Sands ..... 124/1
5,983,879 * 11/1999 Gifford ..... 124/1

* cited by examiner

*Primary Examiner*—John A. Ricci

(57) ABSTRACT

A bow tuning apparatus with a nock travel indicator includes a mounting platform for mounting a compound bow having cam wheels, the mounting platform having first and second deflection measuring gauges on respective first and second sides, to contact the cam wheels for measuring bow deflection as the bow is drawn. An outer frame is mounted to the mounting platform, the outer frame including indicia for measuring bow string travel distance. An inner frame is slidably received in the outer frame, the inner frame having a bow press with rollers to deflect the bow limbs as the inner frame is retracted into the outer frame. A first winch, having a strain gauge, is used to draw the bowstring. A marking pen may be secured to the bowstring, to mark a surface as the bowstring is drawn. A second winch is used to retract the inner frame into the outer frame, to slacken the bowstring.

2 Claims, 5 Drawing Sheets

BOW TUNING APPARATUS WITH A NOCK TRAVEL INDICATOR

BACKGROUND OF THE INVENTION

1. Field of the Invention

The present invention relates to a nock travel indicator and more particularly pertains to a bow tuning apparatus which allows a user to map the travel of a nock upon a bow string.

2. Description of the Prior Art

The use of bow tuning devices is known in the prior art. For example, U.S. Pat. No. 5,121,736 to Hawk discloses an archery bow sighting apparatus for use in effecting vertical alignment of the bow with the bow string. Furthermore, U.S. Pat. No. 4,993,397 to Cryar discloses an apparatus for calibrating archery bows. The apparatus allows the nocking point and other features to be adjusted to optimal positions. U.S. Pat. No. 2,763,156 to Garigal discloses a bow pull indicating machine for use in indicating the force and movement of a bow string attached to a resilient bow. The use of bow presses is also known in the art. For example, U.S. Pat. No. 5,222,473 to Lint; U.S. Pat. No. 5,433,186 to Corwin; and U.S. Pat. No. 5,370,103 to Desselle each disclose bow press devices for use in securing a bow during adjustment and/or maintenance.

Finally, applicant's prior patent, U.S. Pat. No. 5,954,041 entitled "Bow Calibrating Device", the contents of which are incorporated herein by reference, discloses a device for calibrating the draw of an archery bow.

Although the devices described in conjunction with the above-referenced patents achieve their individual objectives and requirements, none of them pertain to a bow tuning apparatus with a nock travel indicator. In this respect, the bow tuning apparatus of the present invention substantially departs from those of the prior art.

BRIEF SUMMARY OF THE INVENTION

The use of bow and arrows has increased in popularity over the years. This popularity comes both in the form of target shooting and bow hunting. The most popular forms of bows today are compound bows. These bows provide an inherent mechanical advantage which reduces the pull force required at full draw. This mechanical advantage, in turn, results in increased accuracy. Those familiar with compound bows will understand the necessity to keep such bows properly calibrated. Improperly calibrated bows result in loss of accuracy and premature wear of the pulleys and wheels. Premature degradation of the bow limbs can also occur as a result of improper calibration. The present invention overcomes the problems inherent in keeping a bow properly calibrated by providing a tuning apparatus which includes a visual nock travel indicator. To this end, the present invention essentially comprises a bow tuning apparatus with a nock travel indicator. The apparatus has, as a first component, an outer frame with measuring indicia formed along the length of the outer frame. A second component is an inner frame slidably positioned within the outer frame. A first winch assembly is secured along a length of the outer frame. Cabling is secured about the first winch and has a distal end secured to the inner frame. In this manner, rotation of the winch causes inward movement of the inner frame with respect to the outer frame. A second winch assembly is secured along a length of the outer frame. Cabling is secured about the second winch assembly. An implement securing means is coupled to the distal end of the cabling of the second winch assembly. Further, a writing implement is positioned within the implement securing means. Lastly, a rigid sheet is removably coupled to the outer frame assembly.

Furthermore, it is an object of the present invention to provide an apparatus whereby a user can easily calibrate a bow.

It is a further object of the present invention to provide a device whereby the travel of the bow string can be recorded for subsequent reference.

An even further object of the present invention is to provide a calibrating device which employs winches and pulleys such that the bow can be drawn with minimal user energy.

It is still yet another object of the present invention to provide a device whereby the initial draw of the bow can be recorded, both in terms of distance and in stress.

Another object of the present invention is to provide a writing implement interconnected with the peak of the bow string such that the travel of the bow string can be recorded and non-linear bow paths may be detected.

These objects of the present invention can be achieved by providing a bow tuning apparatus with a nock travel indicator. The bow tuning apparatus has, as a first component, a mounting platform with first and second sides and a central extent. First and second deflection measuring apparatuses are located on the first and second sides of the platform respectively. An outer frame is secured to the central extent of the mounting platform. Measuring indicia is formed along the length of the outer frame. An inner frame is slidably positioned within the outer frame. The inner frame has a hollow interior. A bow press with associated rollers integral with a forward extent of the inner frame is also provided. The fourth component of the present invention is a first winch assembly secured along a length of the outer frame. A first pulley is rotatably secured at a rearward extent of the outer frame. Cabling is secured about the first winch, the first pulley, and extends within the outer frame with a distal end secured to the interior of the inner frame. In this manner, rotation of the winch causes inward movement of the inner frame with respect to the outer frame. A second winch assembly is secured along a length of the outer frame. A second pulley is secured to the rearward extent of the outer frame. Cabling is secured about the second winch assembly and the second pulley. A strain measuring device is coupled to a distal end of the cabling. An implement securing means is secured to the strain measuring device with a writing implement positioned within the securing means. Lastly provided is a sheet of plexiglass which is removably coupled to the outer frame assembly. A sheet, which has graduations marked thereon, is removably coupled to the plexiglass such that movement of the writing implement corresponds with the movement of a bow string being measured and wherein movement of the writing implement makes marks upon the sheet.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

The present invention relates to a nock travel indicator for use in conjunction with a bow tuning apparatus. The nock travel indicator allows a user to map the travel of a bow string thereby allowing a user to detect any misalignment or misadjustment of a bow string. In its broadest context, the present invention includes a writing implement which is secured adjacent the bow string and which records the path of the bow string on an underlying sheet. The details of the nock travel indicator, as well as additional embodiments, will be presented in greater detail hereinafter.

Figures 1, 2:
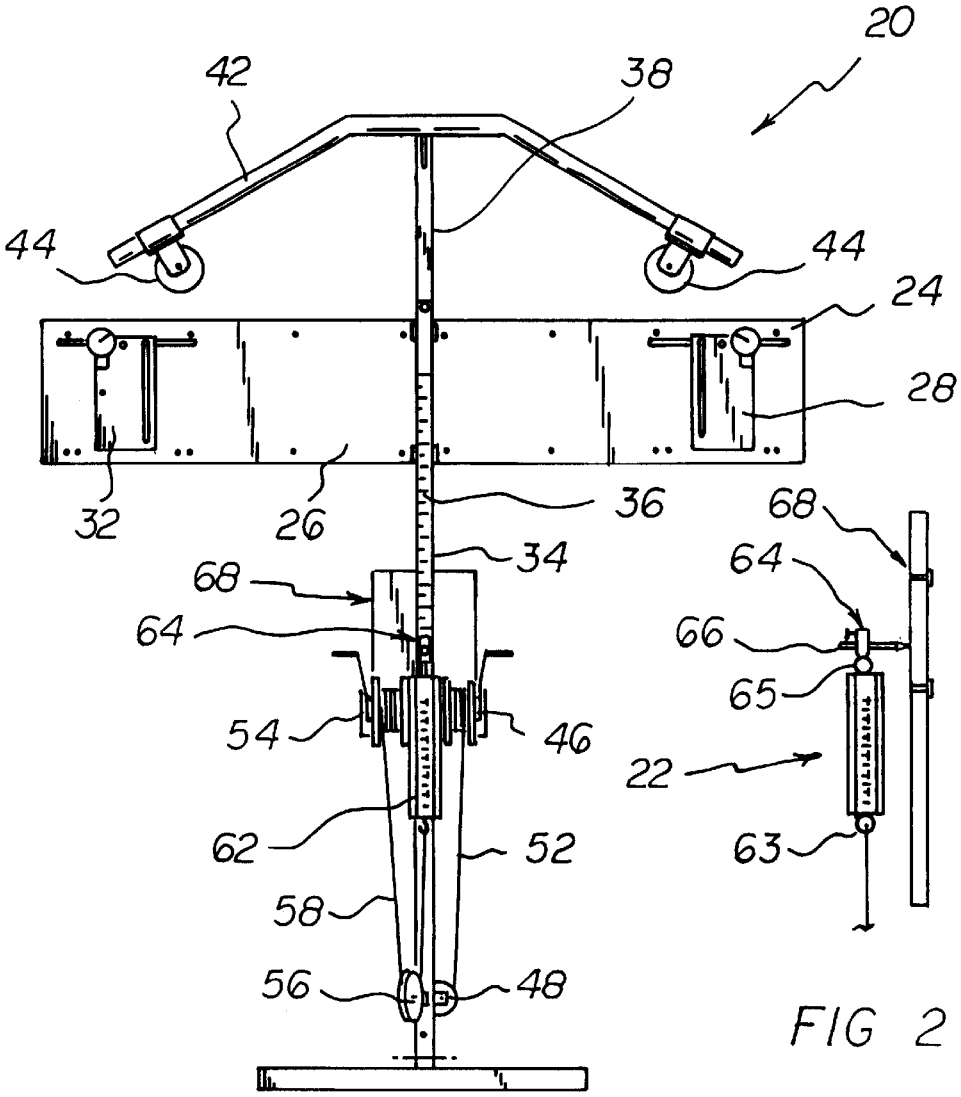
FIG. 1 is a plan view of the bow tuning apparatus of the present invention.
FIG. 2 is a detailed side elevational view taken from FIG. 1.

With reference now to FIG. 1, the preferred embodiment of the nock travel indicator 22 is depicted. This figure illustrates a mounting platform 24 which forms the major structural feature of the bow tuning apparatus 20. Such platform 24 is defined by first and second sides as well as a central extent 26. Furthermore, first and second deflection measuring apparatuses, 28 and 32 respectively, are movably secured to the first and second sides of the platform 24. The nature and function of these deflection measuring apparatuses will be described in greater detail hereinafter.

With continuing reference to FIG. 1, the outer frame 34 of the bow tuning apparatus 20 is depicted. This outer frame 34 is secured to the central extent 26 of the mounting platform 24 by way of threaded fasteners, or the like, such that the platform 24 and frame 34 are fixedly secured to one another. Preferably, measuring indicia 36 is formed along the intermediate length of the outer frame 34. The measuring indicia 36 aids users in determining the travel of a bow string in a manner more fully described hereinafter.

The tuning apparatus 20 further employs an inner frame 38 which is slidably positioned within the outer frame 34. In the preferred embodiment, both the inner and outer frames, 38 and 34 respectively, are of a rectangular cross section and have a hollow interior. Thus, the inner frame 38 is telescopically received within the outer frame 34 such that the bow tuning apparatus 20 can be used with bows of varying shapes and sizes. Furthermore, a bow press 42 is integrally formed at the forward extent of the inner frame 38. The bow press 42 has outer ends, each of which receives a roller 44 thereon. These rollers 44 are adapted to engage the limbs of a bow 45 secured within the apparatus 20 during a bow press operation described more fully hereinafter. The inward force of the inner frame 38 upon a properly positioned bow 45 is governed by a first winch assembly 46.

Figure 3:
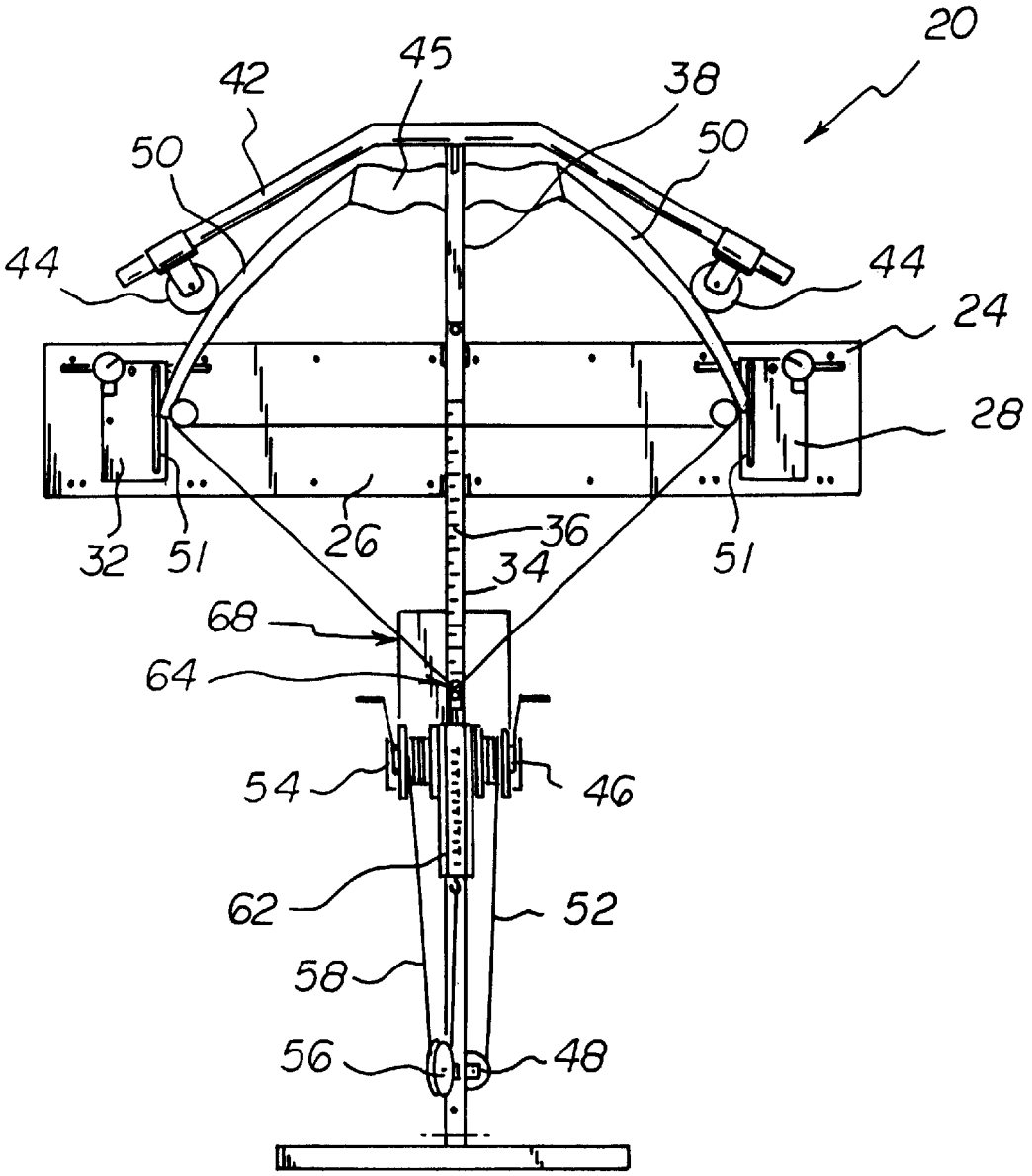
FIG. 3 is a view of the bow tuning apparatus with a bow to be calibrated positioned thereon.
Figure 4:
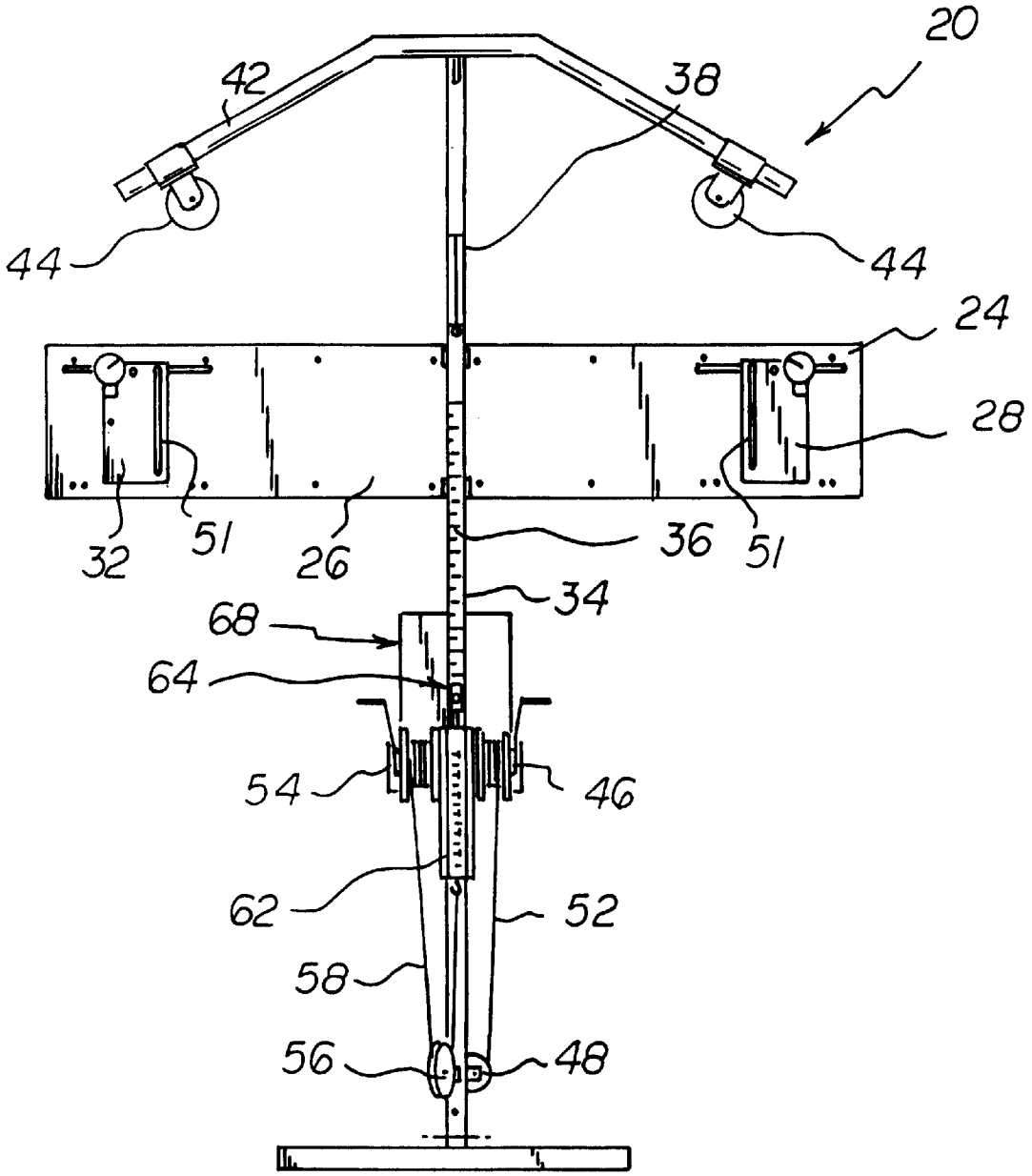
FIG. 4 is a plan view of the bow tuning apparatus in the extended orientation.

This first winch assembly 46 is secured to the intermediate length of the outer frame 34 by way of threaded fasteners or the like. The winch assembly 46 further includes a first pulley 48 which is rotatably secured at the rearward extent of the outer frame 34, note FIG. 1. Cabling 52 is secured about the first winch 46 and threaded about the first pulley 48 with the distal end of the cabling 52 threaded within the interior of the outer frame 34. The distal end of the cabling 52 is secured to the inner frame assembly. Thus, the cabling 52 is threaded within the hollow interior of both the outer and inner frames, 34 and 38 respectively, and secured to the interior of the inner frame 38. FIG. 4 shows a partial sectional view of the cabling 52 threaded within the interior of the inner frame 38. As such, forward rotation of the first winch assembly 46 causes the cabling 52 to be taken up about the periphery of the winch. Furthermore, the first pulley 48 provides a user with a mechanical advantage. Continued winch rotation causes the inner frame 38 to be drawn into the outer frame 34. As noted in FIG. 3 this, in turn, causes the bow press 42 with its associated rollers 44 to engage the limbs 50 of an archery bow 45 positioned within the apparatus 20. As is also evident from FIG. 3, with a bow 45 properly positioned within the apparatus 20, the outer extents of the bow limbs 50 will cause outward pressure to be applied upon the deflection measuring apparatuses 28 and 32. Each of the apparatuses is adapted to travel along the outer length of the mounting platform 24 and to measure the force exerted upon its upstanding edge 51.

The apparatus 20 further includes a second winch assembly 54. This second winch assembly 54 is secured along the intermediate length of the outer frame 34 in a manner similar to the first assembly. The second winch assembly 54 further includes a second pulley 56 which is secured to the rearward extent of the outer frame 34. As with the first assembly 46, cabling 58 is secured about the second winch assembly 54 and the second pulley 56. However, the cabling 58 is not threaded within the interior of the outer frame 34. Rather, the distal end of the cabling 58 is coupled to a strain measuring device 62 by way of a hook 63. The coupling of the distal end of the cabling 58 and the strain measuring device 62 is most clearly depicted in the side elevational view of FIG. 2. The opposite end of the strain measuring device 62 includes a second hook 65. This second hook 65 is adapted to be removably coupled to the bow string of a bow 45 positioned within the apparatus. With continuing reference to FIG. 2, the implement securing means 64 of the nock travel indicator 22 is depicted. This implement securing means 64 is fixedly secured to the second hook 65. The implement securing means 64 employs a threaded fastener, the rotation of which causes force to be supplied upon a writing implement 66 positioned within the securing means 64. Other securing mechanisms are also possible. For example, a simple rubber band or a spring arrangement may also be employed. FIG. 2 also depicts a pencil or other writing implement 66 positioned within the securing means 64. In this manner, the writing implement 66 is interconnected to the distal end of the bow string.

Figure 5:
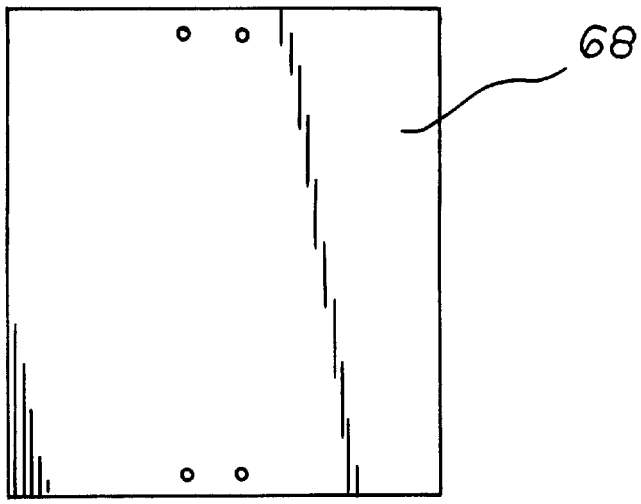
FIG. 5 is a plan view of the rigid sheet employed in conjunction with the nock travel indicator.
Figure 6:
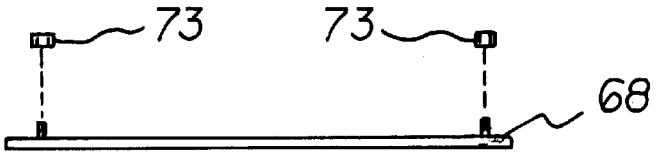
FIG. 6 is a side elevational view of the sheet depicted in FIG. 5.
Figure 7:
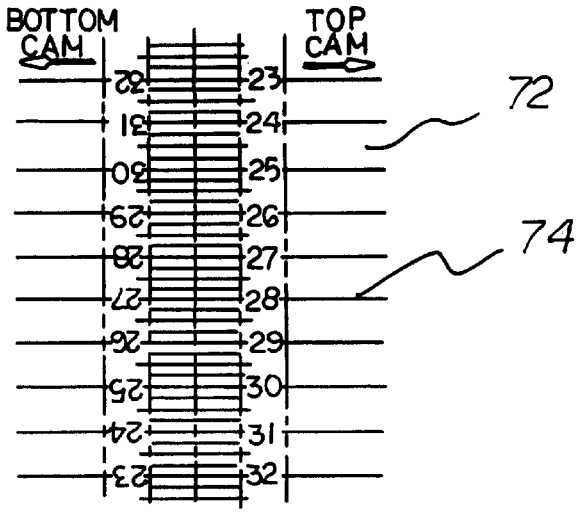
FIG. 7 is a view of the removable sheet with graduations marked thereon.

FIG. 1 depicts the rigid sheet 68 which is removably coupled to the outer frame 34 of the assembly. In the preferred embodiment, this rigid sheet 68 is formed entirely from plexiglass. FIGS. 5 and 6 are detailed views of the plexiglass sheet utilized upon the apparatus 20 of the present invention. As indicated, the outer ends of the sheet include pairs of threaded fasteners 73. In this manner, the sheet 68 can be secured over the top of the outer frame assembly 34 with the fasteners 73 functioning to positively secure the sheet to the apparatus 20. FIG. 7 illustrates a sheet 72 with graduations 74 marked thereon. Such sheet 72 is adapted to be removably coupled to the upper surface of the plexiglass sheet 68 through the use of a removable adhesive or the like.

The sheet 72 together with the plexiglass 68 are adapted to be positioned underneath the writing implement 66 positioned within the securing means 64. Thus, as can be appreciated from FIG. 2, movement of the writing implement 66 causes marks to be made upon the sheet 72 depicted in FIG. 7.

The apparatus thus described can be used in any one of five modes of operation: nock travel indication; synchronization and recording; weakened limb detection; draw length documentation; and finally, for use as a bow press. Each of these usages will be described in greater detail hereinafter.

When being used as a nock travel indicator, care should be taken that the second hook 65 of the securing means 64 is secured to the center of the bow string. Thereafter, the second winch assembly 54 is employed to draw the bow. As this is done, care should be taken to monitor the weight scale 62. As the bow is drawn, the scale will build until it reaches the maximum draw weight and then the holding weight will suddenly let off. This point is known as the valley and is the draw point which requires the least amount of draw weight. This draw weight is also known as the holding weight. Furthermore, the distance the string is pulled to achieve the holding weight is known as the draw length. At this point, the draw length should be recorded by way of measuring indicia 36. Furthermore, the weight should likewise be recorded at the bottom of the valley. Subsequent drawing of the bow via the winch 54 will cause weight to build up again. This is known as the wall. The draw length and weight should again be recorded at this point. Thereafter, the user should install the chart 72 on the plexiglass panel 68. Preferably the chart is installed upon the plexiglass with arrows to indicate the top and bottom of the bow. FIG. 7 illustrates the form of the chart preferably used with notations of top cam and bottom cam indicating the top and bottom of the bow respectively.

As is apparent from FIG. 2, the location of the writing implement is offset with respect to the location of the bow string, which is located in hook 65. Consequently, vertical adjustment should be undertaken to accommodate for this. Typically, there will be about a ¾ inch difference between the location of the writing implement and the location of the string. When the writing implement is inserted into the securing means 64 it should be pushed in until a slight pressure is applied to the chart. Thereafter, the writing implement holder should be secured. Next, the bow should be released slowly by way of the second winch 54. This will cause the writing instrument to scribe a line on the chart. As the bow string moves up, the line drawn will represent the travel of the nock and of the arrow in an up and down motion upon normal release in a vertical position. A straight line will indicate a bow which is in proper tune. An acceptable line can have a 1/16 deviation from straight. Lines in the shape of an "S" indicate that the bow is in need of adjustment. At this point the chart can be saved for taking future tune readings.

The manner in which the apparatus can be employed for synchronization will next be described. The initial steps for synchronization are the same as described above in conjunction with nock travel indication. However, the scribed line should be examined to decipher the lead cam from the trailing cam. Specifically, the scribed line will arch toward the lead cam and away from the trailing cam. Once this determination is made, adjustments should be conducted such that the trailing cam "catches up with" the lead cam. This is accomplished by twisting the end of the buss cable on the trailing cam to thereby shorten its length. Alternatively, the yoke end of the same cable can have one of its sides removed and rotated around the other side of the yoke one time placing it on the same axle and from which it came. Again, this tightens and shortens the length of the cable. In this manner, the cables are twisted and untwisted to make adjustments on the synchronization of the cams. When twisting the cable to achieve timing, the number of twist changes should be recorded in both number and direction.

The apparatus is employed in draw length documentation by recording the draw length upon the Chart of FIG. 7. In this manner subsequent draw lengths can be compared and optimal draw lengths can be repeated.

Employing the apparatus for weakened limb detection will next be described. Such is accomplished by first repeating the steps indicated above with respect to the nock travel indication. Thereafter, with the bow at full draw the swing arm devices, or deflection measuring apparatuses 28 and 32, are brought to the three inch positions. This position is measured from the center of the top axle and likewise the bottom axle to the swing arms hanging straight down against the roll pin. Thereafter, the bow is released about one inch. As this is done, care should be taken to make sure to lock the winch to prevent injury. Next, the distance between the axles and the vertically hanging swing arms are measured. If the limbs are in good condition, these measurements should be very close. However, measurements which are different indicate that the bow has a weak or damaged limb. Even with a weakened limb, the bow can be tuned to shoot properly by achieving straight nock travel. The use of the apparatus as a bow press will now be described. Once a bow is determined to be in need of adjustment, the apparatus can be employed as a press for use while the bow is being adjusted. The first step for use as a bow press is to apply the pressure on the bow strings and cables. Thereafter, with the bow at full draw and making sure that the swing arm devices at the top and bottom are at their extreme outermost positions, the bow press is lowered. This is achieved by way of the first winch assembly 46. Thereafter, the press is lowered until the rollers come into contact with the bow's limbs. Care should be taken to avoid sights and stabilizers. Next, the bow's pressure is slowly released by way of the second winch.

Figure 8:
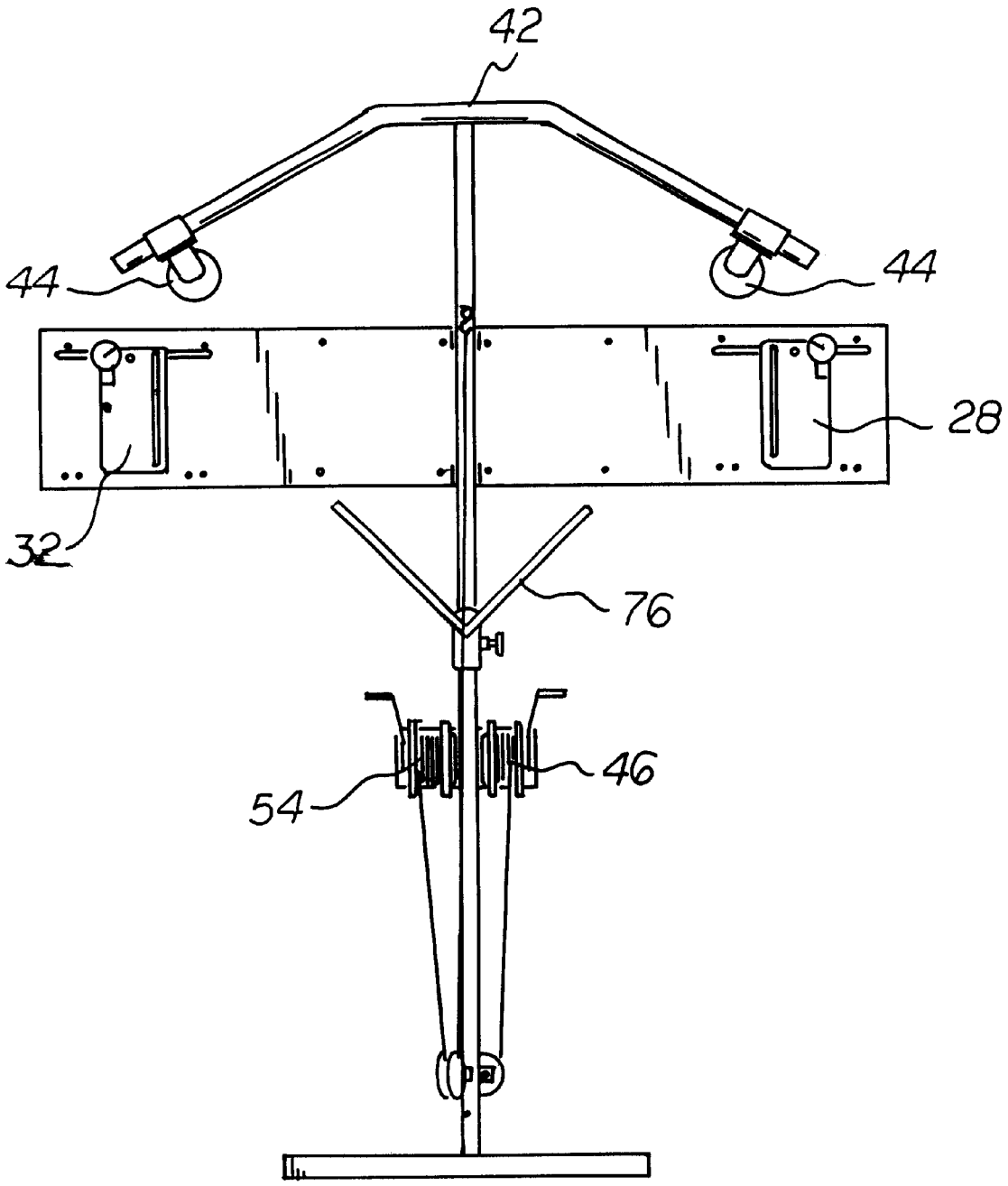
FIG. 8 is a view of an alternative embodiment of the bow tuning apparatus of the present invention.

FIG. 8 illustrates a secondary embodiment of the bow tuning apparatus of the present invention. This apparatus employs an alignment bracket 76 slidably positioned upon the outer frame 34. This alignment bracket 76 may be used to insure that the bow is properly positioned upon the device 20. The apparatus depicted in FIG. 8 may be used in conjunction with the nock travel indicator 22 described in conjunction with FIGS. 1 through 7.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bow tuning apparatus with a nock travel indicator, the apparatus comprising, in combination:

a mounting platform with first and second sides and a central extent, first and second deflection measuring apparatuses on the first and second sides of the platform respectively, the deflection measuring apparatuses adapted to contact the outer extents of bow limbs of a bow supported on the mounting platform whereby when the string of the supported bow is pulled, the bow limbs will move to move the deflection measuring apparatuses and thereby measure the forces exerted;

an outer frame secured to the central extent of the mounting platform, measuring indicia formed along the length of the outer frame to determine the length the bow string is pulled;

an inner frame slidably positioned within the outer frame, the inner frame having a hollow interior, a bow press with associated rollers integral with a forward extent of the inner frame whereby movement of the inner frame into the outer frame will cause the rollers of the bow press to move the outer extents of the bow limbs to induce slack for string and cable removal;

a first winch assembly secured along a length of the outer frame, a first pulley rotatably secured at a rearward extent of the outer frame, first cabling secured about the first winch, the first pulley, and extending within the outer frame and having a distal end secured to the interior of the inner frame, whereby rotation of the winch causes inward movement of the inner frame with respect to the outer frame and the rollers against the outer extents of the bow limbs;

a second winch assembly secured along a length of the outer frame, a second pulley secured to the rearward extent of the outer frame, second cabling secured about the second winch assembly and the second pulley, a strain measuring device coupled to a distal end of the cabling whereby pulling of the second cabling by the second winch assembly with the strain measuring device adapted to determine the draw weight of the bow and, in addition, the draw length from the indicia on the outer frame;

an implement securing means secured to the strain measuring device for movement as the bow string is pulled, a writing implement positioned within the securing means for movement therewith;

and a sheet of plexiglass being removably coupled to the outer frame assembly, a sheet with graduations marked thereon removably coupled to the plexiglass such that movement of the writing implement corresponds with the movement of the bow string being measured and wherein movement of the writing implement makes marks upon the sheet corresponding to the movement of the bow string.

2. A nock travel indication device for use in conjunction with a bow tuning apparatus, the nock travel indication device comprising, in combination:

a rigid sheet with associated fasteners thereon for use in removably coupling the rigid sheet to a bow tuning apparatus;

a writing implement holding means removably coupled to the string of a bow with cams to be calibrated, a writing implement positioned within the holding means, and a supplemental sheet with indicia removably supported on the rigid sheet in contact with the writing implement whereby the drawing of the bow string results in movement of the writing implement and the direction of travel of the bow string being recorded upon the supplemental sheet both vertically for the path of the nock and horizontally for indicating the synchronization of the bow cams.

* * * * *